US005373908A

United States Patent [19]

Pastusek

[11] Patent Number: 5,373,908

[45] Date of Patent: Dec. 20, 1994

[54] CHAMFERED CUTTING STRUCTURE FOR DOWNHOLE DRILLING

[75] Inventor: Paul E. Pastusek, Salt Lake City, Utah

[73] Assignee: Baker Hughes Incorporated, Houston, Tex.

[21] Appl. No.: 28,989

[22] Filed: Mar. 10, 1993

[51] Int. Cl.[5] ..... B23K 31/02

[52] U.S. Cl. ..... 175/431; 175/432; 175/435; 228/165

[58] Field of Search ..... 175/428, 431, 432, 435; 228/165, 166, 174

[56] References Cited

U.S. PATENT DOCUMENTS

| | | | |
|---|---|---|---|
| 4,200,159 | 4/1980 | Peschel et al. | 175/428 |
| 4,498,549 | 2/1985 | Jurgens | 175/428 |
| 4,593,777 | 6/1986 | Barr | 175/431 X |
| 4,607,711 | 8/1986 | Zijsling | 175/431 |
| 4,640,375 | 2/1987 | Barr et al. | 175/431 |
| 4,767,050 | 8/1988 | Flood et al. | 175/428 X |
| 4,848,489 | 7/1989 | Deane | 175/429 |
| 4,877,096 | 10/1989 | Tibbitts | 175/428 X |
| 4,993,505 | 2/1991 | Packer et al. | 175/428 |
| 5,060,739 | 10/1991 | Griffin | 175/428 |
| 5,061,293 | 10/1991 | Barr et al. | 51/293 |

*Primary Examiner*—Roger J. Schoeppel
*Attorney, Agent, or Firm*—Trask, Britt & Rossa

[57] ABSTRACT

A cutting structure for use in a rotary drag bit for downhole drilling is disclosed which relieves stress concentrations focused in the cutting structure along a line adjacent the surface where a cutting element abuts the carrier element or stud. A semicircular polycrystalline diamond compact (PDC) cutting element segment and a cooperating blank segment are diametrically bonded together and, in turn, bonded to a surface on the carrier element. The PDC segment has a chamfer formed along one inner edge, and the blank segment similarly has a chamfer formed along one inner edge. The two segments are joined together along their chamfered edges so that the chamfers are aligned to form a channel through the cutting structure when the segments are bonded to the carrier element. A groove may also be formed in the carrier element along the line where the polycrystalline diamond cutting element, the blank segment and the carrier element are joined, either in addition to or in lieu of the chamfers. The chamfers (and/or optional groove) thereby form a channel through the cutting element which relieves stress concentrations at the line of intersection of the cutting structure components. Another embodiment utilizes a carrier element with a shelf recess in which the PDC segment resides and no blank segment. The inner edge of the shelf or recess includes a radiused undercut extending within the carrier element, which undercut cooperates with the PDC segment chamfer to form the channel.

13 Claims, 5 Drawing Sheets

CHAMFERED CUTTING STRUCTURE FOR DOWNHOLE DRILLING

BACKGROUND OF THE INVENTION

1. Field of the Invention

This invention relates generally to cutting elements for rotary drill bits. Specifically, this invention relates to the mounting of polycrystalline diamond compact (PDC) cutting elements to carrier elements to form a cutting structure in a fashion to reduce concentration of stress at selected interfaces in the carrier/cutting element substructure, which stress concentrations otherwise lead to premature degradation and destruction of the cutting structure and bonds therein.

2. State of the Art

Cutting elements used in rotary drill bits generally comprise a relatively thin layer or table of polycrystalline diamond formed under ultrahigh temperature and pressure on a less hard substrate, typically made of cemented tungsten carbide (WC). The tungsten carbide substrates are then attached by brazing to carrier elements or "back-ups" (also typically of WC) which are secured to the crown of a drill bit, which in turn is connected to a drill string and lowered into a hole for rotary drilling.

PDC cutting elements are usually either round or semicircular. Wear on the PDC cutting element is greatest along the outermost arcuate edge of the element which is in contact with the rock formation, while the remainder of the cutting element remains in a relatively pristine state. Thus, uneven wear and degradation in only one portion of the PDC cutting element necessitates disposing of a greater percentage of relatively unused polycrystalline diamond. Therefore, the industry from time to time has focused on using semicircular PDC elements (hereinafter "segmented" PDC cutting elements) which reduce the amount of wasted polycrystalline diamond material. U.S. Pat. No. 4,498,549, issued to Jürgens and assigned to the assignee of the present invention and U.S. Pat. No. 4,767,050, issued to Flood et al., disclose cutting structures including segmented PDC cutting elements.

Experience has shown that use of semicircular or segmented PDC cutting elements bonded to carrier elements creates stress concentrations at various points or along lines in the cutting structure which are not observed when circular PDC cutting elements are mounted to carrier elements. Stress concentrations occur most often at points or lines of bonding between the cutting element substrate, the tungsten carbide carrier element and a blank, which may also be of WC, mounted adjacent the PDC cutting element on the carrier element to form a wear surface substantially coextensive with the cutting element PDC surface. Alternatively, a shelf or shoulder may be created on the carrier element itself in lieu of the use of the aforementioned wear surface blank, as disclosed in the aforementioned Flood patent, but this type of structure also experiences stress concentrations along the inner edge of the carrier element shelf. With either type of assembly, such stress concentrations promote fracture of the carrier element behind the PDC cutting element, and may also contribute to delamination of the cutting structure as well as spalling and fracture of the PDC cutting element. As a result of such damage, the rate of penetration of the drill bit will be severely reduced, necessitating a halt to drilling and retrieval of the bit for repair or replacement.

Stress-related cutting structure failure is particularly a problem with larger cutting elements, for example ¾" diameter and larger, as the stresses are magnified by the size of the cutting structure and fewer cutters are employed on large-cutter bits, so that the loss of a single cutter may effectively bring drilling to a halt.

Cutting structure configurations which have been specifically designed to limit stress concentrations in assemblies of round or circular PDC cutting elements and carrier elements are disclosed in U.S. Pat. No. 4,993,505 to Packer et al. and U.S. Pat. No. 5,060,739 to Griffin, both of which patents address the occurrence of stress fractures at the bonding point between the tungsten carbide cutting element substrate and the stud (carrier element). Additionally, U.S. Pat. No. 5,061,293 to Barr et al. discloses a cutting element where a PDC layer is formed between a first layer and a second layer of tungsten carbide to stabilize the PDC layer during cutting.

None of the foregoing patents, however, disclose a means or method to minimize stress concentrations when a conventional, segmented PDC cutting element is bonded to a carrier element adjacent a blank or into a pocket, shelf, shoulder or other recessed structure of a carrier element. Thus, it would be advantageous to provide a cutting structure which relieves stress forces at the interface between a segmented PDC cutting element and the stud or other carrier element of the cutting structure.

SUMMARY OF THE INVENTION

A cutting structure for use in a rotary drill bit is configured to provide relief from stress forces concentrated at interfaces between a segmented PDC cutting element and the carrier element to which it is bonded. Relief of stress concentrations is effected, in accordance with the present invention, by configuring the PDC cutting element, the carrier element, and a blank mounted adjacent the PDC cutting element on the carrier element with chamfers or other cooperating recesses or reliefs to form a channel transsecting the cutting structure through the width or lateral extent thereof.

The cutting structure of the preferred embodiment of the present invention employs a semicircular segment of a polycrystalline diamond compact (PDC), which is comprised of a diamond table formed on a circular substrate, the substrate with diamond table then being cut into segments, generally along a diametrical line. The PDC segment, which is slightly smaller than a half-circle due to the width of the material removed when it is formed, and a cooperating substantially semicircular segment, referred to herein as a "blank," (which may be made slightly larger than a half-circle to mate with the PDC segment), are assembled with a carrier element (also referred to as a "back-up" or a "stud" or "cylinder"). The substrate, blank and carrier element are comprised of a hard material, such as tungsten carbide. The PDC segment substrate and the blank segment each have a surface which abuts and mates with a corresponding surface of the other segment when both are mounted on a surface of the carrier element.

The mating substrate surface of the PDC segment is bonded to the mating surface of the blank disk by means well-known in the industry, such as high temperature brazing, and both are further bonded simultaneously to the carrier element surface by similar means.

Because stress forces are known to concentrate at interfaces in the cutting structure, such as the point or line where the PDC segment substrate is bonded to the blank and to the carrier, back up or stud, chamfers are formed along the inner edges of the mating surfaces of the PDC segment substrate and the blank segment, and a groove corresponding to, and in alignment with the chamfers is formed in the carrier element surface. The channel thus formed by the convergence of the chamfers and groove provides a line of stress relief through or across the diameter or width of the cutting structure.

In an alternative embodiment, chamfers are formed along the inner edges of the PDC segment substrate and the blank segment mating surfaces to form a channel through or across the diameter or width of the cutting structure. In this embodiment, no groove is provided in the carrier element surface in alignment with the chamfers formed in the segments. The cooperating chamfers of the segments provide a line of stress relief in the cutting structure.

In another alternative embodiment no blank is employed, and the cutting element chamfer cooperates with an undercut proximate the inner edge of a shelf or recess in the carrier element.

In yet another alternative embodiment, an unchamfered PDC segment and an unchamfered blank are employed, and a groove is formed in the surface of the carrier element aligned with the line of abutment between the PDC segment and the blank segment. In this embodiment, the groove provides a line of stress relief across the cutting structure.

BRIEF DESCRIPTION OF THE DRAWINGS

In the drawings, which illustrate what is currently considered to be the best mode for carrying out the invention.

DETAILED DESCRIPTION OF THE ILLUSTRATED EMBODIMENTS

Figure 1:
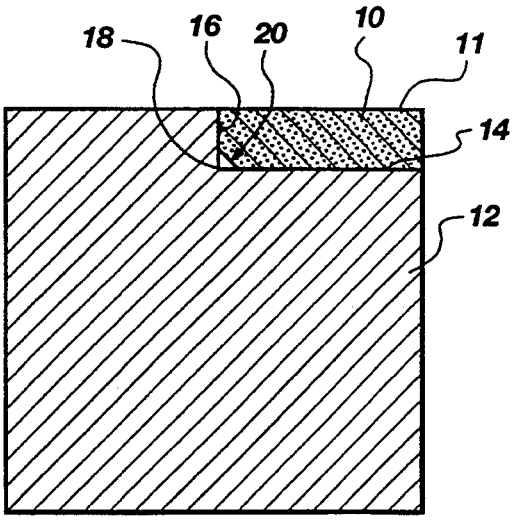
Fig. 1 (PRIOR ART)
FIG. 1 is a cross-sectional view of a prior art cutting structure.

For purposes of comparison, FIG. 1 illustrates a prior art cutting structure where the substrate of a segmented PDC cutting element 10 including a diamond table 11 is bonded (as by brazing) to a carrier element 12, both typically made of a hard material such as tungsten carbide, along a major surface 14. The cutting element 10 is also bonded to carrier element 12 along a minor surface 16, the mutually perpendicular surfaces 14 and 16 creating a shelf, shoulder or recess for receipt of cutting element 10. Stress forces induced during the bonding process become concentrated at the line of intersection 18 between the major surface 14 and minor surface 16. A chamfer 20 is formed along the inner edge of the cutting element 10 abutting line of intersection 18, as disclosed in the aforementioned U.S. Pat. No. 4,767,050, to provide a relief to clear the radius at the intersection of carrier element surfaces 14 and 16 so that the cutting element 10 will closely abut carrier element 12. The prior art configuration shown in FIG. 1, however, has proven to be ineffective in relieving or reducing stress concentrations in the area of intersection 18.

Figure 2:
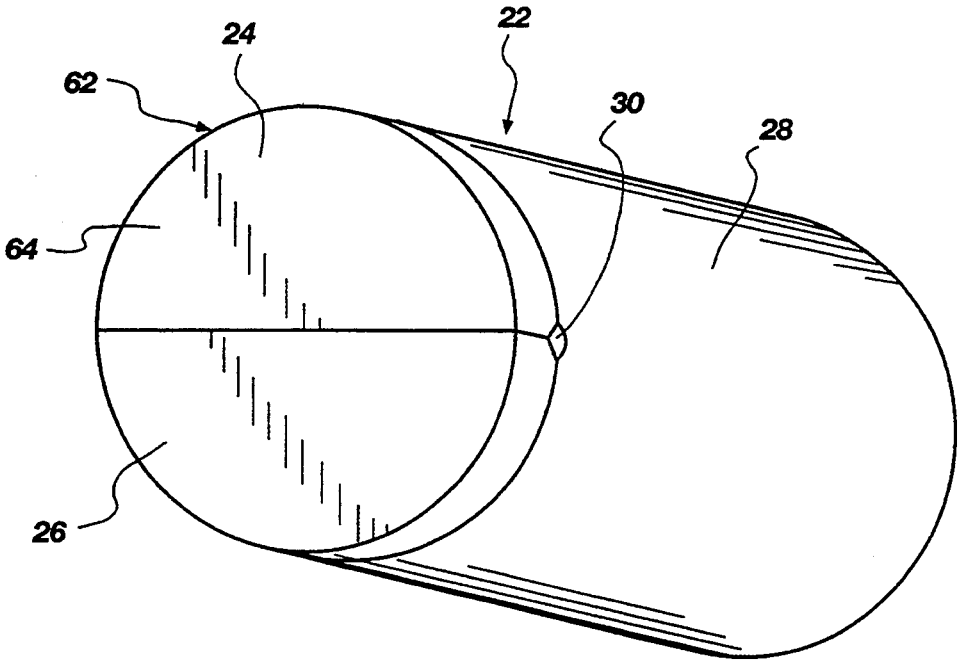
FIG. 2 is a perspective view of a cutting structure of the present invention.

In accordance with the present invention, FIG. 2 illustrates an exemplary embodiment in which the cutting structure 22 includes a semicircular (although other shapes are possible, such as tombstone shaped or half-oval cutters) polycrystalline diamond compact (PDC) cutting element 24 having a diamond table 25 and bonded via its substrate to a semicircular complementary blank 26, typically made of a hard material such as tungsten carbide similar to that of the PDC cutting element substrate. The element 24 and the blank 26 are further bonded as by brazing to a stud or carrier element 28, which is also typically made of tungsten carbide or other suitable hard material. The carrier element 28 is attachable to a bit crown (not shown) in a manner which positions the PDC cutting element 24 above the crown. A channel 30 is formed through cutting structure 22 at the intersection of the PDC cutting element 24, blank 26 and carrier element 28.

Figure 3:
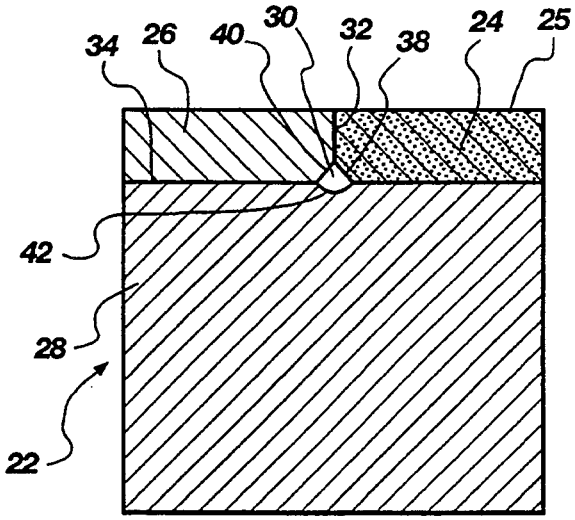
FIG. 3 is a cross-sectional view of the cutting structure shown in FIG. 2.

As more fully illustrated by FIG. 3, the cutting structure 22 of the present invention includes a blank 26 which mates with the substrate of the PDC cutting element 24 along a minor plane 32. The PDC cutting element 24 and the blank 26 are also bonded to the carrier element 28 along a major plane 34. As previously noted, the means of bonding may be any well-known in the art, such as brazing. The blank 26 may be semicircular in shape, as suggested by FIGS. 2 and 3, but may also be formed in any other suitable shape. It is only important that the substrate of the PDC cutting element 24 and blank 26 mutually cooperate along at least one mating minor plane 32.

The substrate of the semicircular PDC cutting element 24 has a chamfer 38 formed adjacent the inner edge of minor plane 32. Similarly, the blank 26 has a chamfer 40 formed adjacent the inner edge of minor plane 32. Chamfer 38 and chamfer 40 are formed in the PDC cutting element 24 and blank 26, respectively, so that they form a space or gap at the inner extent of the mating surfaces of the PDC cutting element 24 and blank 26. A groove 42 is formed across plane 34 of the carrier element 28, along which the PDC cutting element 24 and blank 26 are bonded to carrier element 28. The groove 42 is positioned across the diameter of the carrier element 28 and is aligned with the cooperating chamfers 38 and the PDC cutting element 24 and 40 of the blank 26 to form a channel 30 through the cutting structure 22. Chamfers 38 and 40 may comprise either single or double chamfers, or curved surfaces. It is preferred that groove 42 be of arcuate cross-sectional configuration, such as a segment of a circle, ellipse or other ovoid, although, triangular, rectangular or other cross-sectional configurations may also be employed.

Figure 4:
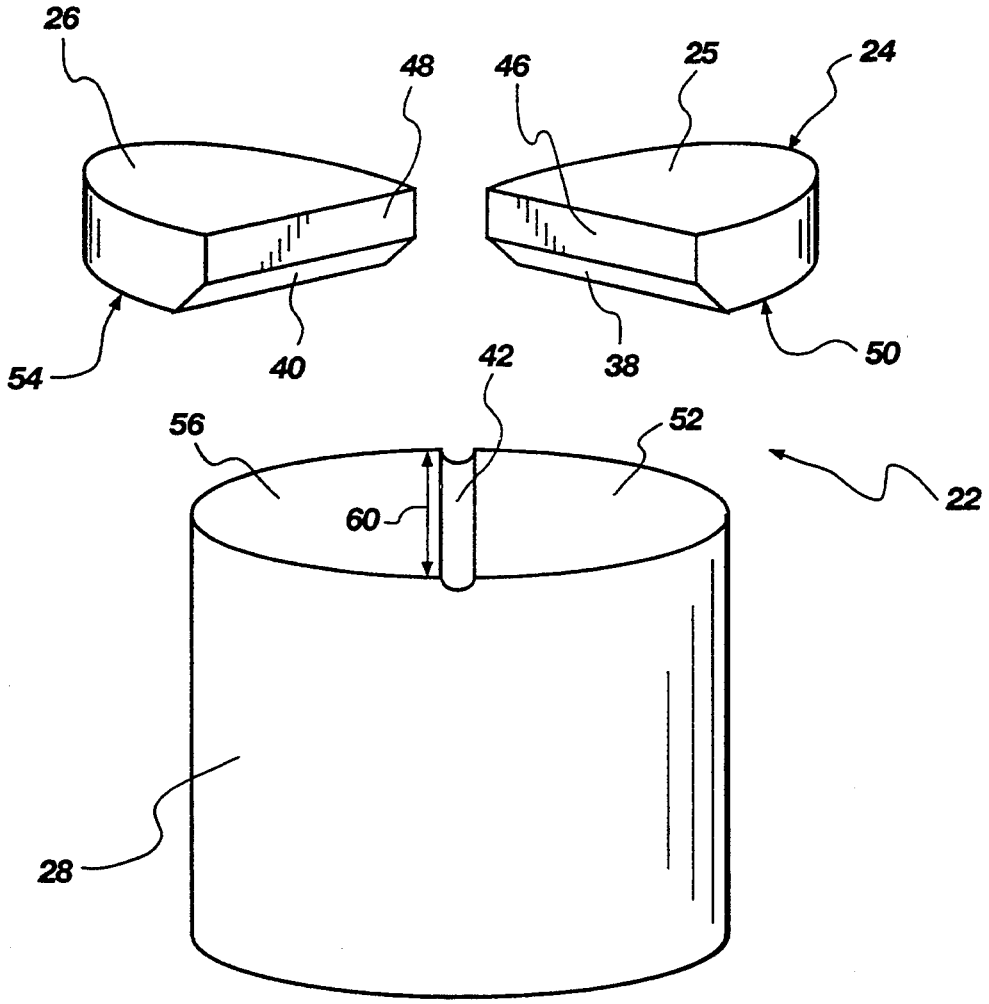
FIG. 4 is an exploded perspective view of the cutting structure shown in FIG. 2.

FIG. 4 more clearly illustrates that the PDC cutting element 24 has a minor surface 46 which abuts minor surface 48 of the blank 26 along minor plane 32 when cutting structure 22 is assembled. The PDC cutting element 24 and blank 26 are bonded together along the respective minor surfaces 46 and 48. The PDC cutting element 24 has an undersurface 50 which is bonded to a first supporting surface 52 of the carrier element 28. Likewise, the blank 26 has an undersurface 54 which is bonded to a second supporting surface 56 of the carrier element 28, undersurfaces 50 and 54 and supporting surfaces 52 and 56 being co-extensive with major plane 34 when cutting structure 22 is assembled. When the PDC cutting element 24, blank 26 and carrier element 28 are bonded together as previously described, chamfers 38 and 40 are aligned with the groove 42 formed in the carrier 28 to define channel 30, as illustrated in FIG. 3, through the diameter 60 of the cutting structure 22.

In operation, force is applied against the PDC cutting element 24 along arcuate edge 62 and PDC layer 64 when contact is made between the PDC cutting element 24 and formation material, or rock. Resulting stress forces are manifested at the line of intersection between the PDC cutting element 24, the blank 26 and the carrier element 28 an area in which prior art cutting structures of this type are susceptible to damage due to the pre-existing concentrations of stresses induced by the bonding process. Finite element analysis (FEA) has demonstrated that such stresses are roughly twice as large as any generated in a cutting structure employing a full-round cutter of comparable diameter. This phenomenon has been demonstrated in FEA simulation of both soft and hard formation drilling. The result of the stress concentration in soft formation drilling is for the PDC half round cutter segment to rotationally separate in a backward direction (opposite the direction of bit rotation) from the blank, due to dominance of the horizontal component of the force applied to the cutting structure during drilling. In hard formations, the vertical component of the force applied to the cutting structure is dominant, and the PDC segment shears or slides backwardly with respect to the blank. In either case, cyclic and dynamic drilling loads significantly increase the likelihood of failure of such structures in comparison to that of a full round cutting element of comparable diameter bonded to a carrier element. However, because of the channel 30 formed through the diameter of the cutting structure 22 of the present invention, no pre-existing concentrations of stresses exist to which cutting-induced forces are added. Therefore, the composite cutting structure 22 of the present invention possesses sufficient integrity that it does not degrade in operation.

Figure 5:
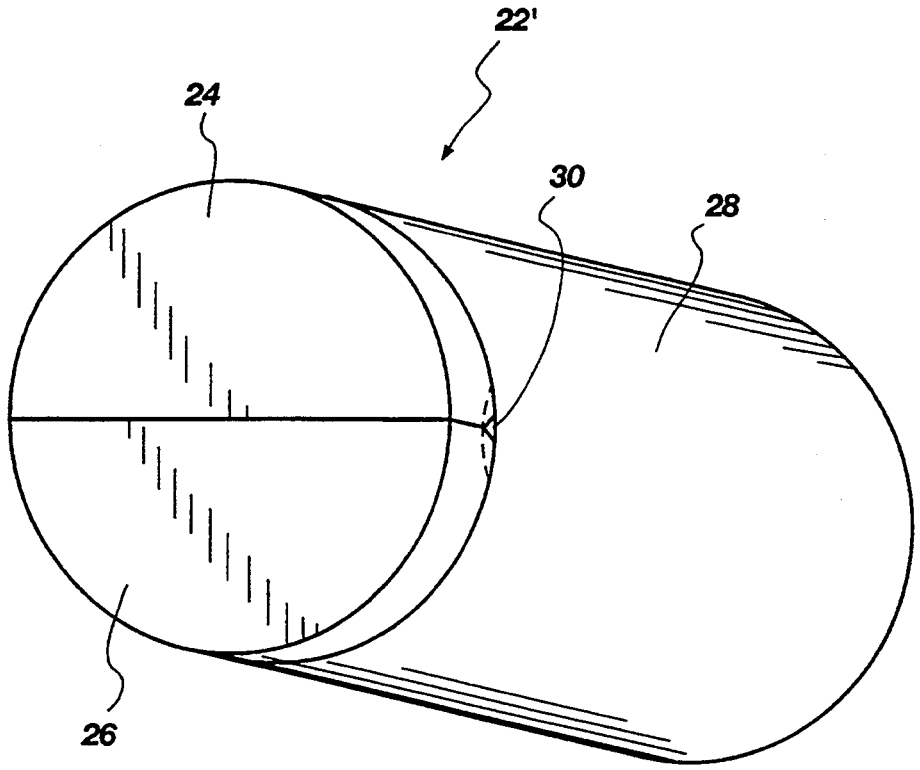
FIG. 5 is a perspective view of a cutting structure illustrating an alternative embodiment.
Figure 6:
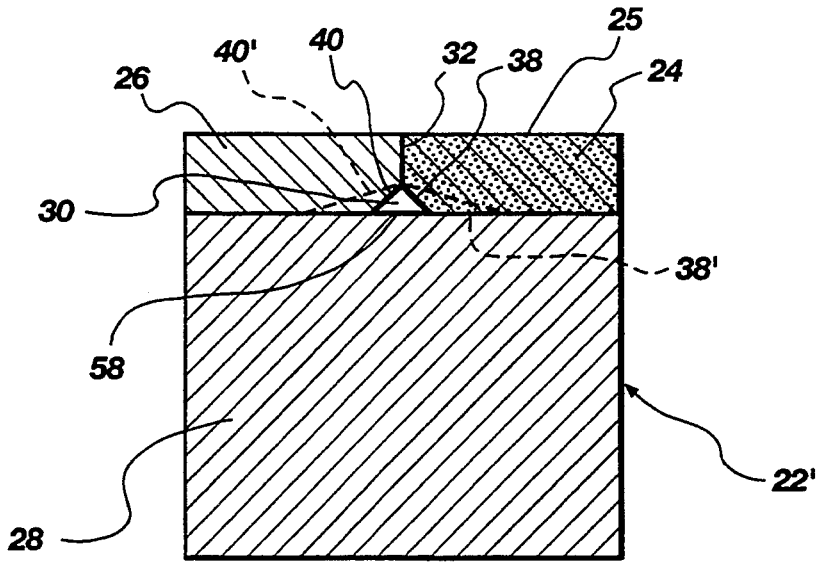
FIG. 6 is a cross-sectional view of the cutting structure shown in FIG. 5.

An alternative embodiment of the cutting structure 22′ may, as illustrated by FIGS. 5 and 6, comprise a semicircular PDC cutting element 24 and a mating blank 26 bonded to a carrier element 28. A chamfer 38 is formed in the PDC cutting element 24 and a chamfer 40 is formed in the blank 26. The chamfers 38 and 40 of the segments 24 and 26 are aligned to form a channel at the intersection of the PDC cutting element 24, the blank 26 and the carrier element 28. Unlike the previously described embodiment, there is no groove formed in the carrier element 28. Thus, the channel 30 is triangulately configured, with the chamfers 38 and 40 and horizontal surface 58 of the carrier 28 forming the walls of the channel 30. As shown in broken lines on FIGS. 5 and 6, chamfers 38 and 40 may be made shallower and wider as referenced by 38′ and 40′ to provide the desired stress relief without compromising integrity of the cutting structure.

Figure 7:
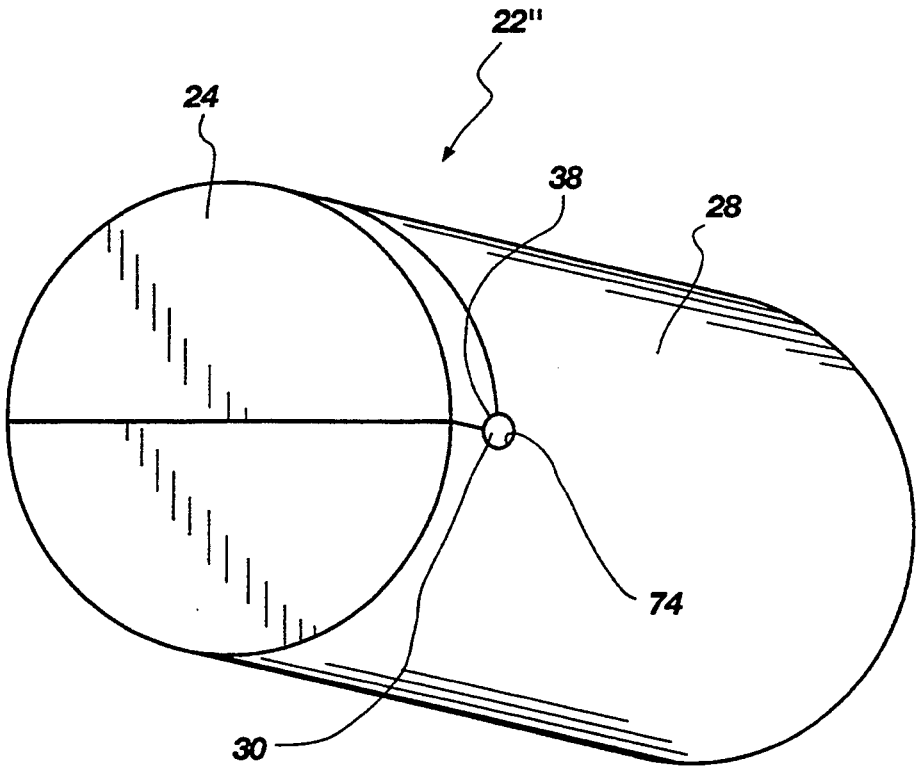
FIG. 7 is a perspective view of a cutting structure illustrating a second alternative embodiment.
Figure 8:
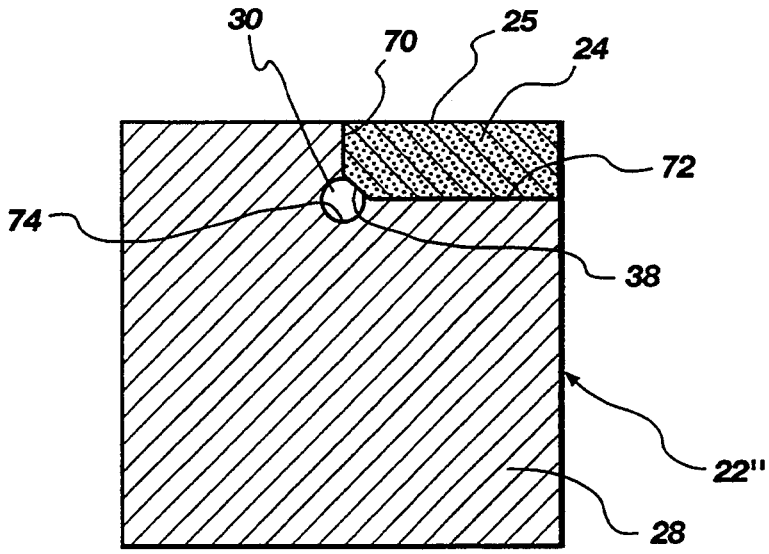
FIG. 8 is a cross-sectional view of the cutting structure shown in FIG. 7.

A second alternative embodiment of the cutting structure 22″ may, as illustrated by FIGS. 7 and 8, comprise a semicircular PDC cutting element 24 bonded to a carrier element 28 having a minor surface 70 and a relatively perpendicular major surface 72. A chamfer 38 is formed in the PDC cutting element 24, while a radiused undercut 74 is formed within carrier element 28 at the intersection of major and minor surfaces 72 and 70. The chamfer 38 is aligned with undercut 74 to form a channel 30 extending across the width of cutting structure 22″. Unlike the two previously described embodiments, there is no blank employed in cutting structure 22″.

Figure 9:
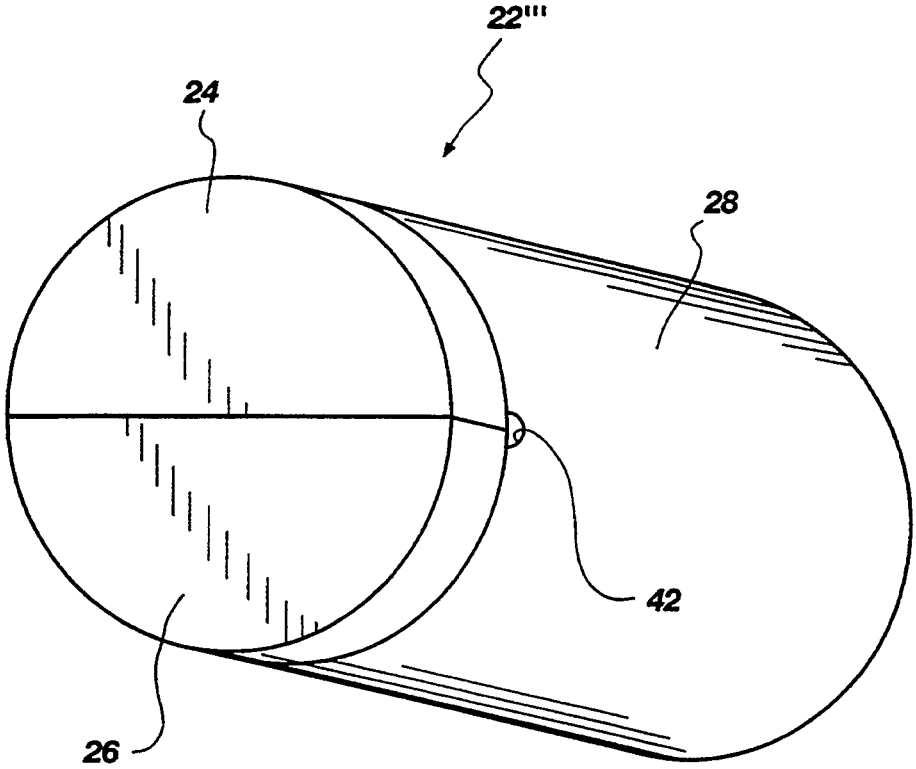
FIG. 9 is a perspective view of a cutting structure illustrating a third alternative embodiment; ant
Figure 10:
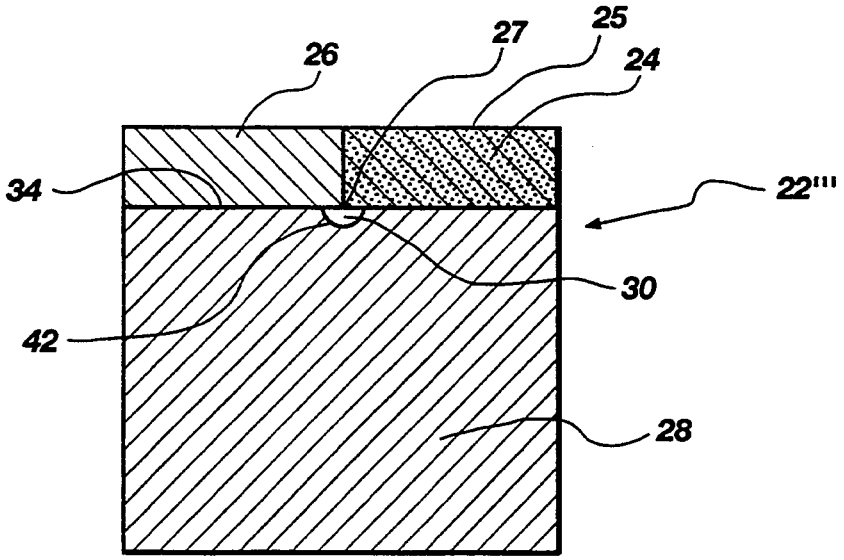
FIG. 10 is a cross-sectional view of the cutting structure shown in FIG. 9.

A third alternative embodiment of the cutting structure 22‴ may, as illustrated by FIGS. 9 and 20, comprise a semicircular PDC cutting element 24 and a mating blank 26 bonded to a carrier element 28. PDC cutting element 24 and blank 26 are unchamfered in this embodiment. However, a groove 42 is formed in major plane 34 of carrier element 28, and the line of abutment 27 of PDC cutting element 24 and blank 26 is co-aligned with groove 42 to form a channel 30 across the width of cutting structure 22‴ to provide the desired stress relief.

The present invention provides relief of stress concentrations exerted on the cutting structures of a drill bit crown during drilling, and can be successfully adapted to other, different configurations of cutting elements and carrier elements. Thus, reference herein to specific details of the illustrated embodiments is by way of example and not by way of limitation. It will be apparent to those skilled in the art that many modifications of the basic illustrated embodiments may be made without departing from the spirit and scope of the invention as recited in the claims.

What is claimed is:

1. A cutting structure for use in a rotary drag bit for drilling subterranean earth formations, comprising:
   - a carrier element including a flat surface thereon;
   - a PDC cutting element segment having a first flat surface and a second, substantially perpendicular flat surface;
   - a blank segment having a first flat surface and a second, substantially perpendicular flat surface;
   - said PDC cutting element segment and said blank segment being joined together along a line of abutment at said first flat surfaces and to said carder element flat surface at said second flat surfaces; and
   - a channel including a groove formed in said carrier element flat surface aligned with said line of abutment to define a wall of said channel.

2. The cutting structure of claim 1, wherein said PDC cutting element segment and said blank segment comprise diametrically abutting substantially semicircular segments, and said carrier element flat surface is circular.

3. The cutting structure of claim 2, wherein said PDC cutting element segment includes a chamfer proximate a line of intersection between its said first and second substantially perpendicular flat surfaces, said PDC cutting element segment chamfer defining a wall of said channel.

4. The cutting structure of claim 1, wherein said PDC cutting element segment includes a chamfer proximate a line of intersection between its said first and second substantially perpendicular flat surfaces, said PDC cutting element segment chamfer defining a wall of said channel.

5. The cutting structure of claim 1, wherein said blank segment includes a chamfer proximate a line of intersection between its said first and second substantially perpendicular flat surfaces, said blank segment chamfer defining a wall of said channel.

6. The cutting structure of claim 5, wherein said PDC cutting element segment includes a chamfer proximate a line of intersection between its said first and second substantially perpendicular flat surfaces, said PDC cutting element segment chamfer defining a wall of said channel.

7. A cutting structure for use in a rotary drag bit for drilling subterranean earth formations, comprising:

a carrier element including a first flat surface and a second flat surface substantially perpendicular thereto, together defining a shelf;

a PDC cutting element including a first flat surface and a second flat surface substantially perpendicular thereto of like dimensions to said carrier element first and second surfaces;

a chamfer along the line of intersection of said PDC cutting element first and second flat surfaces, and a radiused undercut along the line of intersection of said carrier element first and second flat surfaces; and said PDC cutting element surfaces being bonded to said carrier element surfaces, and said chamfer and undercut cooperatively defining a channel within said cutting structure.

8. The cutting structure of claim 7, wherein said PDC cutting element is semicircular.

9. The cutting structure of claim 8, wherein one of said carrier element surfaces is semicircular, and of like size to said PDC cutting element.

10. The cutting structure of claim 9, wherein the other of said carrier element surfaces is of like depth to said PDC cutting element.

11. A cutting structure for use in a rotary drag bit for drilling subterranean earth formations, comprising:

a carrier element including a flat surface thereon;

a PDC cutting element segment having a first flat surface, a second, substantially perpendicular flat surface and a chamfer at a line of intersection between said first and second substantially perpendicular flat surfaces;

a blank segment having a first flat surface, a second, substantially perpendicular flat surface and a chamfer at a line of intersection between said first and second substantially perpendicular flat surfaces;

said PDC cutting element segment and said blank segment being joined together along a line of abutment at said first flat surfaces and to said carrier element flat surface at said second flat surfaces; and a channel within said cutting structure formed along said line of abutment and at least in part by said chamfer of said PDC cutting element and said chamfer of said blank segment.

12. The cutting structure of claim 11, further including a groove formed in said carrier element flat surface aligned with said line of abutment to define a wall of said channel.

13. The cutting structure of claim 11, wherein said PDC cutting element segment and said blank segment comprise diametrically abutting substantially semicircular segments, and said carrier element flat surface is circular.

* * * * *

UNITED STATES PATENT AND TRADEMARK OFFICE

CERTIFICATE OF CORRECTION

PATENT NO. : 5,373,908

DATED : December 20, 1994

INVENTOR(S) : Paul E. Pastusek

It is certified that error appears in the above-indentified patent and that said Letters Patent is hereby corrected as shown below:

In Column 6, line 47, change "carder" to --carrier--.

Signed and Sealed this

Twenty-fifth Day of April, 1995

*Attest:*

Bruce Lehman

BRUCE LEHMAN

*Attesting Officer*

*Commissioner of Patents and Trademarks*